US008262265B2

(12) United States Patent
Hsieh

(10) Patent No.: US 8,262,265 B2
(45) Date of Patent: Sep. 11, 2012

(54) LAMP DEVICE

(75) Inventor: Duan-Cheng Hsieh, Taipei (TW)

(73) Assignee: Habitex Corporation, Taipei (TW)

( * ) Notice: Subject to any disclaimer, the term of this patent is extended or adjusted under 35 U.S.C. 154(b) by 418 days.

(21) Appl. No.: 12/694,211

(22) Filed: Jan. 26, 2010

(65) Prior Publication Data

US 2011/0182079 A1 Jul. 28, 2011

(51) Int. Cl.
*F21S 8/00* (2006.01)

(52) U.S. Cl. ..... 362/427; 362/153; 362/269; 362/287; 362/418; 362/431

(58) Field of Classification Search ..... 362/153, 362/269, 287, 418, 427, 431
See application file for complete search history.

(56) References Cited

U.S. PATENT DOCUMENTS 5,097,400 A * 3/1992 Cvek ..... 362/287
5,716,126 A * 2/1998 Meyer ..... 362/287
6,705,750 B1 * 3/2004 Won ..... 362/419
8,021,026 B2 * 9/2011 Liu et al. ..... 362/419
2011/0051437 A1 * 3/2011 Ng et al. ..... 362/427

* cited by examiner

*Primary Examiner* — Stephen F Husar
*Assistant Examiner* — James Cranson, Jr.
(74) *Attorney, Agent, or Firm* — Kilpatrick Townsend & Stockton LLP

(57) ABSTRACT

A lamp device includes a supporting housing connected fixedly to a base disposed on a supporting surface, and having an inclined top surface inclined with respect to the supporting surface. A lamp-mounting housing is connected pivotally to the supporting housing, has an inclined connecting surface parallel to and facing the inclined top surface of the supporting housing, and is rotatable relative to the supporting housing about a pivot axis perpendicular to the inclined top surface of the supporting housing between a first position, where the supporting housing cooperates with the lamp-mounting housing to constitute an upright structure, and a second position, where the supporting housing cooperates with the lamp-mounting housing to constitute a bent structure. A lamp unit is mounted to the lamp-mounting housing such that the lamp unit emits light toward the supporting surface when the lamp-mounting housing is at the second position.

4 Claims, 4 Drawing Sheets

LAMP DEVICE

BACKGROUND OF THE INVENTION

1. Field of the Invention

The invention relates to a lamp device, more particularly to a lamp device capable of switching between a stand-lamp state and a table-lamp state.

2. Description of the Related Art

A conventional lamp device, such as a stand lamp or a table lamp, is provided for a unique purpose, and may not be suitable for other purposes as required.

Therefore, it is desired to design a lamp device that is suitable for different purposes.

SUMMARY OF THE INVENTION

Therefore, an object of the present invention is to provide a lamp device capable of switching between a stand-lamp state and a table-lamp state.

According to the present invention, a lamp device comprises:

a base adapted to be disposed on a supporting surface;

a supporting housing connected to the base, and having an inclined top surface that is inclined with respect to the supporting surface;

a lamp-mounting housing connected pivotally to the supporting housing, and having an inclined connecting surface parallel to and facing the inclined top surface of the supporting housing, the lamp-mounting housing being rotatable relative to the supporting housing about a pivot axis transverse to the inclined top surface of the supporting housing between a first position, where the supporting housing cooperates with the lamp-mounting housing to constitute an upright structure, and a second position, where the supporting housing cooperates with the lamp-mounting housing to constitute a bent structure; and a lamp unit mounted to the lamp-mounting housing such that the lamp unit emits light toward the supporting surface when the lamp-mounting housing is at the second position.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
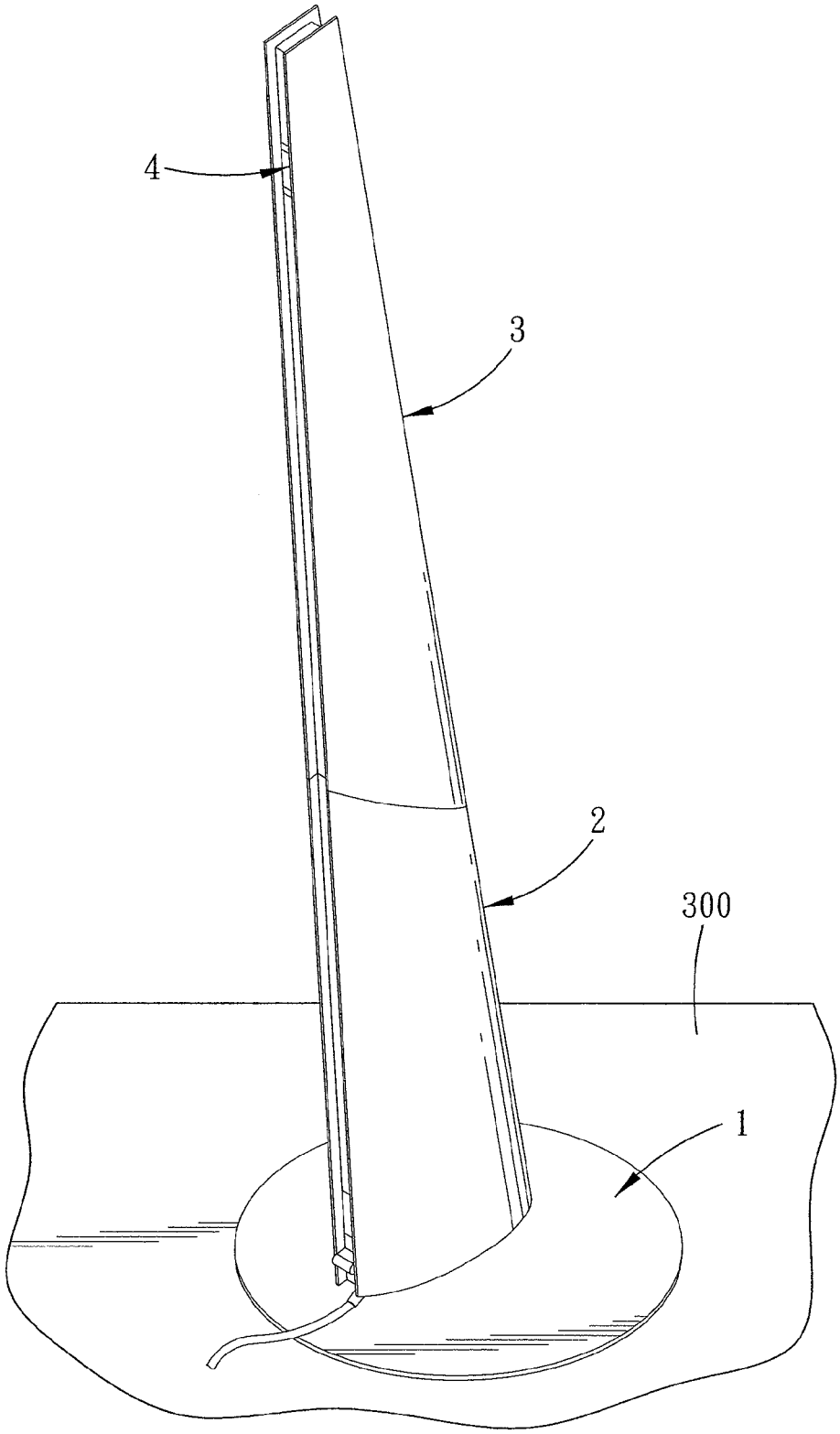
FIG. 1 is a perspective view showing the preferred embodiment of a lamp device according to the present invention when in a stand-lamp state.
Figure 2:
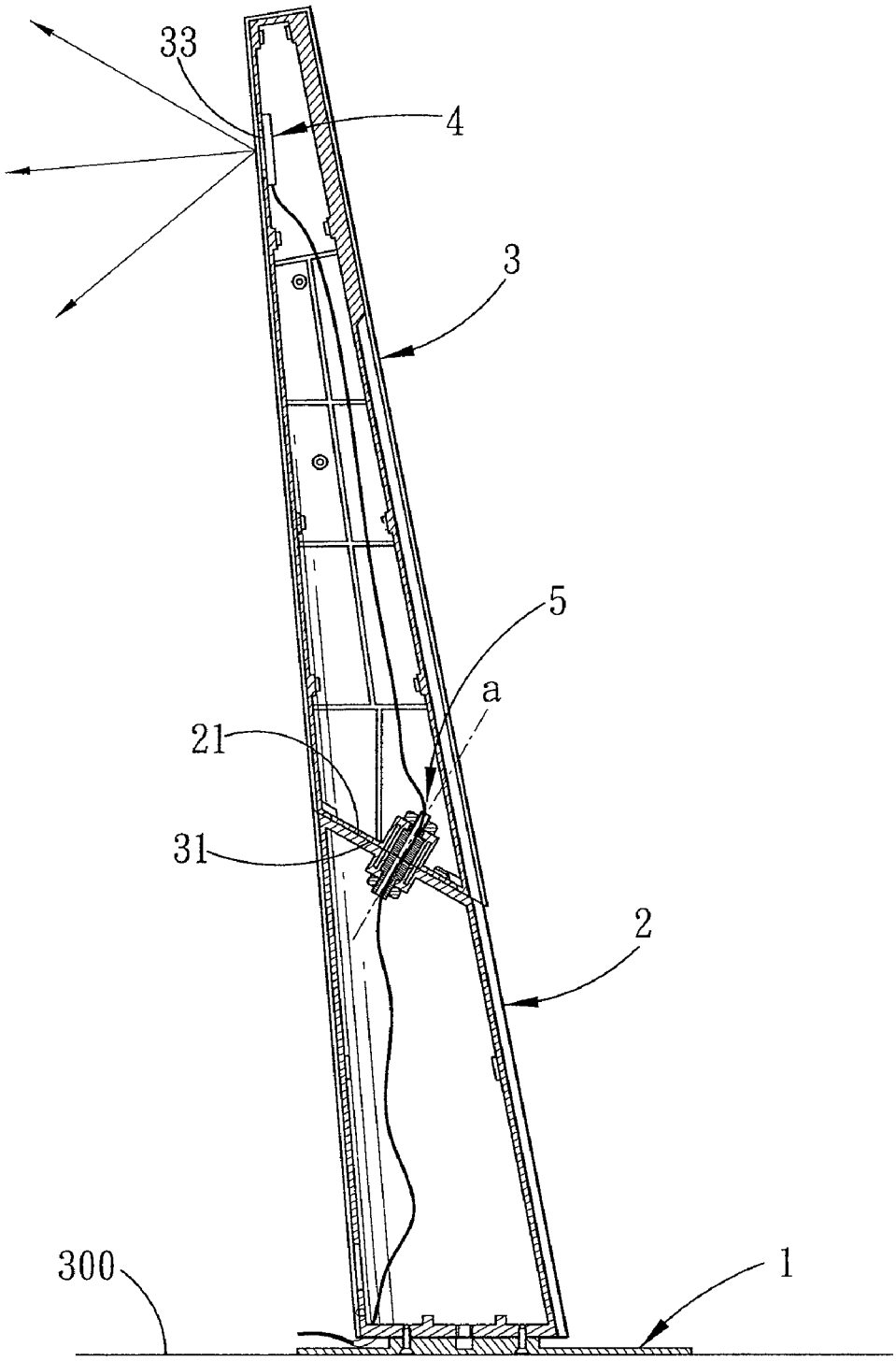
FIG. 2 is a schematic sectional view of FIG. 1.

Referring to FIGS. 1 and 2, the preferred embodiment of a lamp device according to the present invention is shown to include a base 1, a supporting housing 2, a lamp-mounting housing 3, a pivot unit 5, and a lamp unit 4.

The base 1 is in the form of a disc body in this embodiment, and is adapted to be disposed on a supporting surface 300, such as a table surface.

The supporting housing 2 is connected fixedly to the base 1, and has an inclined top surface 21 that is inclined with respect to the supporting surface 300. In this embodiment, the inclined top surface 21 is formed with a first through hole 22 that extends along a pivot axis (a) that is transverse to the inclined top surface 21.

The lamp-mounting housing 3 is connected pivotally to the supporting housing 2, and has an inclined connecting surface 31 parallel to and facing the inclined top surface 21 of the supporting housing 2. In this embodiment, the inclined connecting surface 31 is formed with a second through hole 32 that extends along the pivot axis (a). The lamp housing 3 is further formed with an opening 33 that is disposed distal from the inclined connecting surface 31 in this embodiment.

Figure 3:
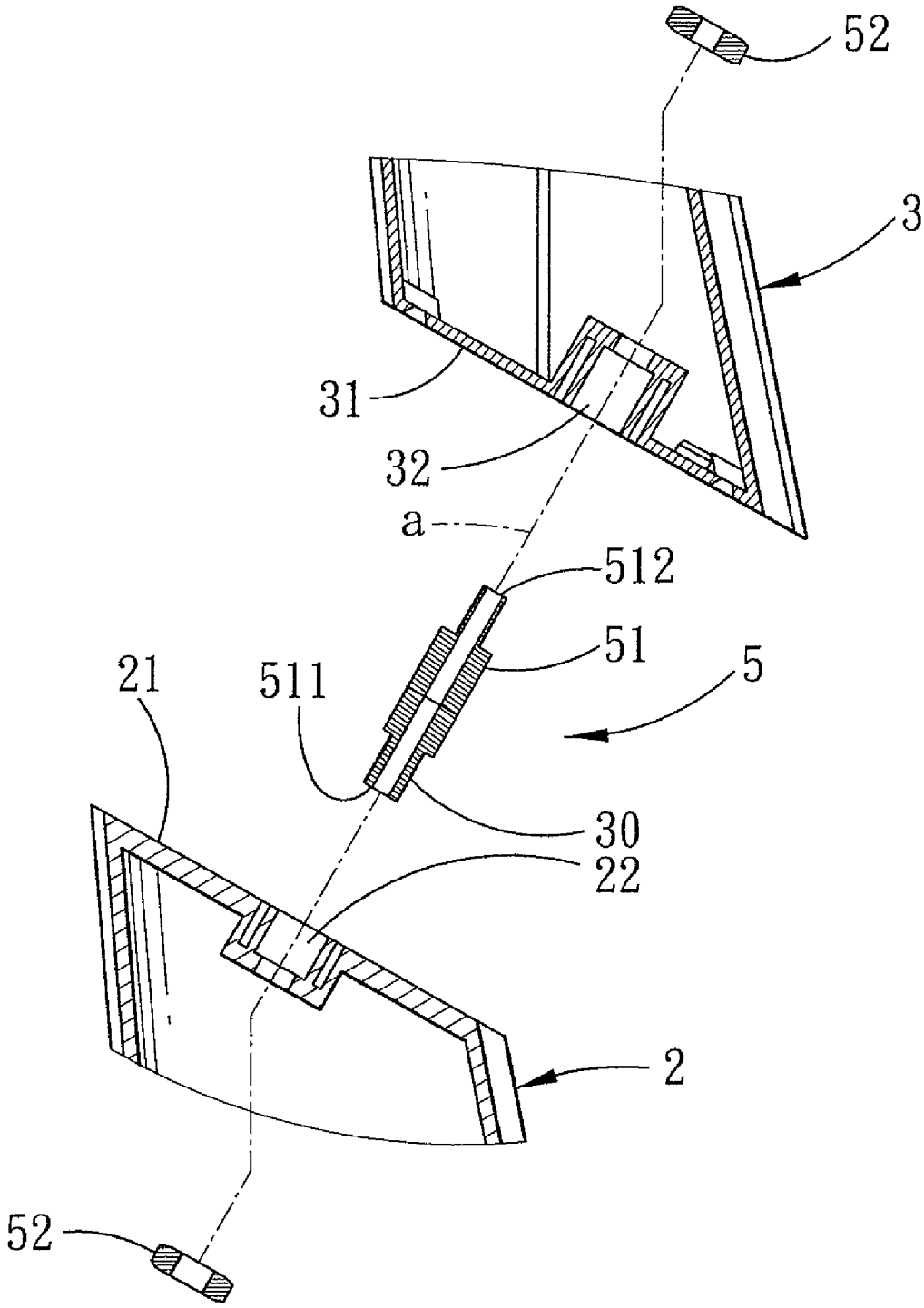
FIG. 3 is an exploded, fragmentary schematic sectional view showing a pivot unit, a supporting housing and a lamp-mounting housing of the preferred embodiment.

Referring further to FIG. 3, the pivot unit 5 interconnects pivotally the supporting housing 2 and the lamp-mounting housing 3. In this embodiment, the pivot unit 5 includes a hollow screw rod 51 and two fastening nuts 52. The screw rod 51 extends through the first and second through holes 22, 32 in the supporting housing 2 and the lamp-mounting housing 3. The screw rod 51 has a first end 511 extending outwardly of the first through hole 22 into the supporting housing 2, and a second end 512 opposite to the first end 511 and extending outwardly of the second through hole 32 into the lamp-mounting housing 3. The fastening nuts 52 are connected respectively to the first and second ends 511, 512 of the screw rod 51. As a result, the lamp-mounting housing 3 is rotatable relative to the supporting housing 2 about the pivot axis (a) between a first position, where the supporting housing 2 cooperates with the lamp-mounting housing 3 to constitute an upright structure, as shown in FIGS. 1 and 2, and a second position, where the supporting housing 2 cooperates with the lamp-mounting housing 3 to constitute a bent structure, as shown in FIG. 4.

Figure 4:
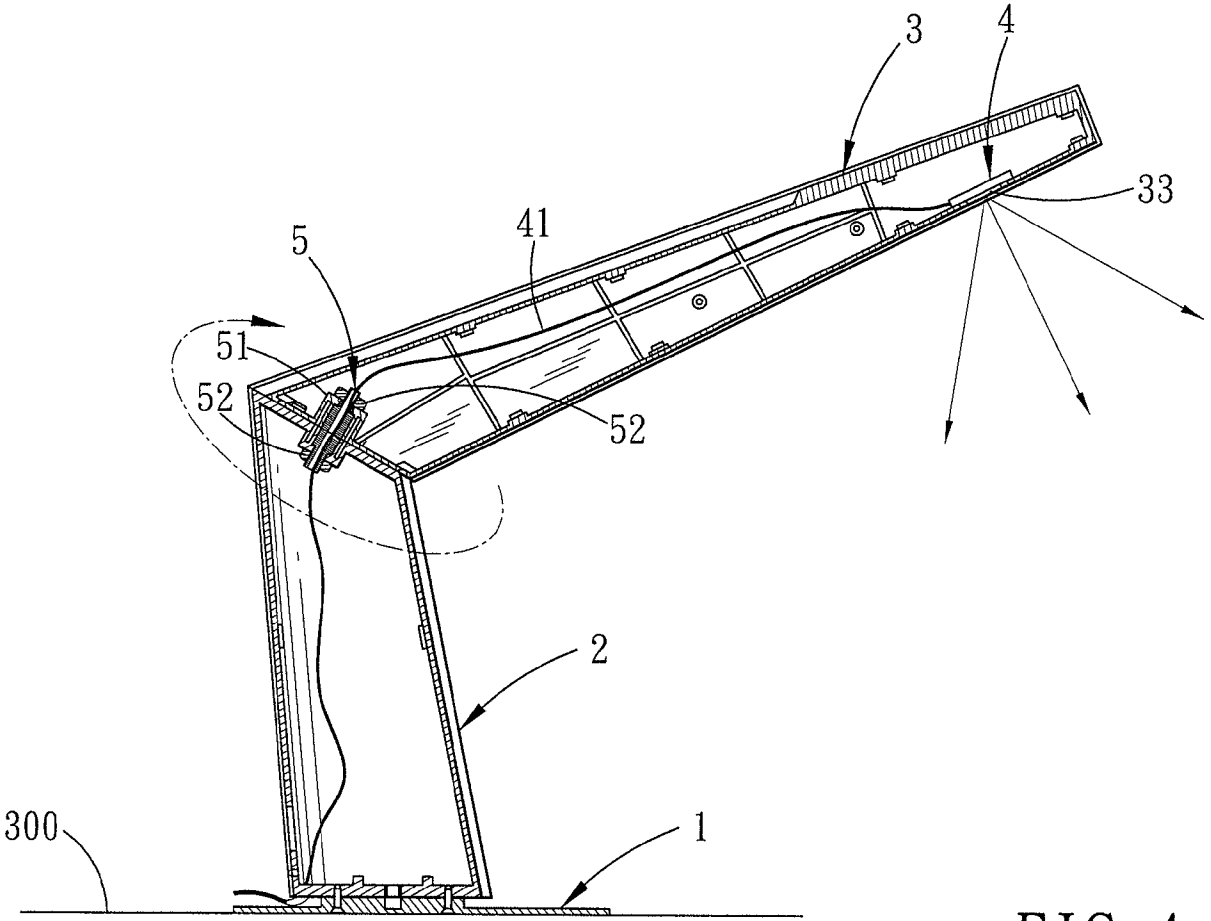
FIG. 4 is a schematic sectional view showing the preferred embodiment when in a table-lamp state.

The lamp unit 4 is mounted in the lamp-mounting housing 3 such that the lamp unit 4 emits light toward the supporting surface 300 when the lamp-mounting housing 3 is at the second position, as shown in FIG. 4. In this embodiment, the lamp unit 4 includes a set of LEDs (not shown), and is adapted to be connected electrically to a power source (not shown) through an electric wire 41 that passes through the hollow screw rod 51. In other embodiments, the lamp unit 4 can include a light tube or a light bulb. It is noted that the lamp unit 4 is disposed adjacent to the opening 33 in the lamp-mounting housing 3 such that light emitted by the lamp unit 4 radiates through the opening 33.

In such a configuration, the lamp device of the present invention can be easily operated through rotation of the lamp-mounting housing 3 between a stand-lamp state, where the lamp-mounting housing 3 is at the first position such that the lamp device with the upright structure can serve as a stand lamp, and a table-lamp state, where the lamp-mounting housing 3 is at the second position such that the lamp device with the bent structure can serve as a table lamp.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A lamp device comprising:

a base adapted to be disposed on a supporting surface;

a supporting housing connected to said base and having an inclined top surface that is inclined with respect to the supporting surface;

a lamp-mounting housing connected pivotally to said supporting housing, and having an inclined connecting surface parallel to and facing said inclined top surface of said supporting housing, said lamp-mounting housing being rotatable relative to said supporting housing about a pivot axis transverse to said inclined top surface of said supporting housing between a first position, where said supporting housing cooperates with said lamp-mounting housing to constitute an upright structure, and a second position, where said supporting housing cooperates with said lamp-mounting housing to constitute a bent structure; and a lamp unit mounted to said lamp-mounting housing such that said lamp unit emits light toward the supporting surface when said lamp-mounting housing is at the second position.

2. The lamp device as claimed in claim 1, further comprising a pivot unit for interconnecting pivotally said supporting housing and said lamp-mounting housing.

3. The lamp device as claimed in claim 2, wherein:

said inclined top surface of said supporting housing is formed with a first through hole extending along the pivot axis;

said inclined connecting surface of said lamp-mounting housing is formed with a second through hole extending along the pivot axis; and said pivot unit including a hollow screw rod extending through said first and second through holes in said supporting housing and said lamp-mounting housing, and having a first end extending outwardly of said first through hole into said supporting housing, and a second end opposite to said first end and extending outwardly of said second through hole into said lamp-mounting housing, and two fastening nuts connected respectively to said first and second ends of said screw rod.

4. The lamp device as claimed in claim 1, wherein said lamp-mounting housing is formed with an opening permitting radiation of light emitted by said lamp unit therethrough.

* * * * *